US011688323B2

(12) United States Patent
Lin

(10) Patent No.: US 11,688,323 B2
(45) Date of Patent: Jun. 27, 2023

(54) PIXEL ARRAY

(71) Applicant: HUIZHOU CHINA STAR OPTOELECTRONICS TECHNOLOGY CO., LTD, Guangdong (CN)

(72) Inventor: Yuecu Lin, Guangdong (CN)

(73) Assignee: HUIZHOU CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 472 days.

(21) Appl. No.: 16/614,058

(22) PCT Filed: Oct. 16, 2019

(86) PCT No.: PCT/CN2019/111404
§ 371 (c)(1),
(2) Date: Nov. 15, 2019

(87) PCT Pub. No.: WO2020/248453
PCT Pub. Date: Dec. 17, 2020

(65) Prior Publication Data

US 2021/0343221 A1 Nov. 4, 2021

(30) Foreign Application Priority Data

Jun. 11, 2019 (CN) ..... 201910499191.3

(51) Int. Cl.
*G09G 3/20* (2006.01)

(52) U.S. Cl.
CPC ... *G09G 3/2074* (2013.01); *G09G 2300/0452* (2013.01); *G09G 2320/0242* (2013.01); *G09G 2320/0666* (2013.01)

(58) Field of Classification Search
CPC ..... G09G 2300/0443; G09G 2300/0452
See application file for complete search history.

(56) References Cited

U.S. PATENT DOCUMENTS 7,710,388 B2 * 5/2010 Hirata ..... G09G 3/2003 345/103
8,018,476 B2 * 9/2011 Credelle ..... G09G 3/2074 345/690
8,338,832 B2 * 12/2012 Kim ..... H01L 27/3202 257/72
8,780,019 B2 * 7/2014 Choi ..... G09G 3/3208 345/77

(Continued)

FOREIGN PATENT DOCUMENTS

CN 103325315 A 9/2013
CN 103545344 A 1/2014

(Continued)

*Primary Examiner* — Patrick F Marinelli

(57) ABSTRACT

A pixel array is provided. The pixel array includes a plurality of pixel units. Each pixel unit correspondingly includes a plurality of sub-pixels having a plurality of color types, and the sub-pixels having the color types include at least one blue sub-pixel. In the pixel array, a proportion of the at least one blue sub-pixel is larger than a proportion correspondingly of at least one sub-pixel of the sub-pixels correspondingly having each color type of other color types of the color types.

14 Claims, 4 Drawing Sheets

(56) References Cited

U.S. PATENT DOCUMENTS 8,860,642 B2 * 10/2014 Phan ..... G09G 3/20 345/88
9,013,381 B2 * 4/2015 Kim ..... H01L 27/3211 345/83
9,245,479 B2 * 1/2016 Park ..... G09G 3/3233
9,307,584 B2 * 4/2016 Ko ..... H01L 27/3218
9,330,621 B2 * 5/2016 Kurasawa ..... G09G 3/3648
9,691,319 B2 * 6/2017 Chu-Ke ..... G09G 3/2003
9,812,049 B2 * 11/2017 Yang ..... G09G 3/20
9,852,701 B2 * 12/2017 Kurasawa ..... G09G 3/3696
9,953,574 B2 * 4/2018 Dighde ..... G09G 3/3233
10,147,770 B2 * 12/2018 Zhang ..... H01L 27/3216
10,192,938 B2 * 1/2019 Yu ..... H01L 27/3276
10,354,592 B2 * 7/2019 Han ..... H01L 27/1218
10,540,927 B2 * 1/2020 Park ..... G09G 3/3233
10,586,496 B2 * 3/2020 Kim ..... G09G 3/3275
10,665,149 B2 * 5/2020 Sears ..... G09G 3/2003
11,062,645 B1 * 7/2021 Xu ..... G09G 3/32
11,088,209 B2 * 8/2021 Shih ..... H01L 27/3216
2004/0036421 A1 * 2/2004 Arnold ..... G09G 3/3225 315/169.3
2005/0168423 A1 * 8/2005 Hirata ..... G09G 3/2003 345/88
2006/0139503 A1 * 6/2006 Larson ..... G02F 1/134336 349/39
2007/0108443 A1 * 5/2007 Kim ..... H01L 27/3244 257/40
2007/0206013 A1 * 9/2007 Brown Elliott ..... G09G 3/2003 345/441
2007/0273619 A1 * 11/2007 Kitazawa ..... G09G 3/3233 345/76
2008/0049048 A1 * 2/2008 Credelle ..... G09G 3/2074 345/690
2009/0059137 A1 3/2009 Lo
2009/0079351 A1 * 3/2009 Choi ..... H01L 27/3218 315/169.3
2009/0128458 A1 * 5/2009 Kim ..... H01L 27/3211 345/76
2011/0074838 A1 * 3/2011 Yamamoto ..... G09G 3/3233 345/690
2011/0279049 A1 * 11/2011 Kawabe ..... G09G 3/3233 315/228
2011/0279493 A1 * 11/2011 Phan ..... G09G 3/2003 345/694
2011/0292019 A1 * 12/2011 Yamamoto ..... G09G 3/3258 345/211
2011/0310137 A1 * 12/2011 Kajiyama ..... G09G 3/3225 345/690
2012/0147065 A1 * 6/2012 Byun ..... G09G 3/3208 345/690
2012/0268502 A1 * 10/2012 Kurasawa ..... G09G 3/3413 345/690
2013/0070006 A1 * 3/2013 Yang ..... G09G 3/3225 345/694
2014/0111563 A1 * 4/2014 Hwang ..... H04N 13/398 345/691
2014/0203262 A1 * 7/2014 Kwak ..... G09G 3/3233 257/40
2014/0204008 A1 * 7/2014 Chu-Ke ..... G09G 3/2003 345/88
2014/0292622 A1 * 10/2014 Lee ..... H01L 27/3262 345/80
2014/0320476 A1 * 10/2014 Choi ..... G09G 3/3258 345/212
2015/0009104 A1 1/2015 Kim et al.
2015/0009194 A1 * 1/2015 Kim ..... G09G 3/3233 345/211
2015/0009242 A1 * 1/2015 Park ..... G09G 3/3233 345/690
2015/0248855 A1 * 9/2015 Kim ..... G09G 3/3291 345/590
2015/0332628 A1 * 11/2015 Ren ..... G09G 3/2003 345/690
2016/0043148 A1 2/2016 Wu et al.
2016/0057817 A9 * 2/2016 Ko ..... G09G 3/3208 313/1
2016/0189670 A1 * 6/2016 Kim ..... G09G 5/02 345/690
2016/0196780 A1 * 7/2016 Chu-Ke ..... G09G 3/2003 345/88
2016/0210913 A1 * 7/2016 Kurasawa ..... G09G 3/3648
2016/0321989 A1 * 11/2016 Dighde ..... G09G 3/2081
2017/0148365 A1 * 5/2017 Xi ..... G09G 3/2003
2017/0169748 A1 * 6/2017 Chen ..... G09G 3/2003
2017/0287988 A1 * 10/2017 Lee ..... H01L 27/3218
2018/0158883 A1 * 6/2018 Zhang ..... H01L 27/3218
2018/0204889 A1 * 7/2018 Yu ..... H01L 27/3223
2018/0226023 A1 * 8/2018 Park ..... G09G 3/3233
2018/0293944 A1 * 10/2018 Kim ..... G09G 3/3275
2019/0012971 A1 * 1/2019 Lee ..... G09G 5/18
2019/0066587 A1 * 2/2019 Han ..... H01L 27/1218
2019/0318678 A1 * 10/2019 Sears ..... G09G 3/007
2021/0027751 A1 * 1/2021 Tang ..... G09G 5/14
2021/0143231 A1 * 5/2021 Chae ..... H01L 27/1255
2021/0193025 A1 * 6/2021 Xu ..... G09G 3/3677
2021/0225245 A1 * 7/2021 Chen ..... G09G 3/20
2021/0264859 A1 * 8/2021 Liu ..... G09G 3/3258
2021/0272508 A1 * 9/2021 Fujii ..... G09G 3/3233
2021/0295781 A1 * 9/2021 Kim ..... G09G 3/3275
2021/0327972 A1 * 10/2021 Lou ..... G09G 3/3225
2021/0343221 A1 * 11/2021 Lin ..... G09G 3/2074

FOREIGN PATENT DOCUMENTS

CN 104036700 A 9/2014
CN 204360740 U 5/2015
CN 104716163 A 6/2015
CN 105679222 A 6/2016
CN 205984991 U 2/2017
CN 110111722 A 8/2019

* cited by examiner

PIXEL ARRAY

CROSS-REFERENCE TO RELATED APPLICATIONS

This application is a Stage application of International Application No. PCT/CN2019/111404, filed Oct. 16, 2019, which claims priority to and the benefit of Chinese Patent Application No. 201910499191.3, filed Jun. 11, 2019, the entireties of which are hereby incorporated herein by reference.

FIELD OF INVENTION

The present disclosure relates to a technical field of displays, and more particularly to a pixel array.

BACKGROUND OF INVENTION

In-plane color shifts are an important parameter for evaluating panel quality. In-plane color shifts are an important indicator of display color uniformity of different regions of gray scale screens. Therefore, how to improve color uniformity and make in-plane color shifts as small as possible is an inevitable problem for various panel manufacturers.

Currently, to improve an in-plane color shift, an industry primarily uses color demura (color compensation) technology. The technology is similar to demura (luminance compensation) technology and is different in that the demura technology aims at luminance non-uniformity, and the color demura aims at in-plane color non-uniformity. The color demura technology uses an integrated algorithm in an integrated circuit (IC) to adjust a plurality of gray scales of a plurality of different regions, thereby improving the color uniformity. Although the aforementioned method may improve the in-plane color shift, an additional IC cost is needed.

SUMMARY OF INVENTION

Technical problems of the present disclosure are as follows.

In order to ensure display consistency of a gray scale screen of a display panel, white balance correction needs to be performed on the display panel. However, after the white balance correction is performed on the display panel, an in-plane color shift is worsened. This is primarily because after the white balance correction is performed, a plurality of gray scale values correspondingly of a plurality of blue sub-pixels drop a lot, causing in-plane color to be non-uniform, and a display effect to be affected.

Technical solutions of the present disclosure are as follows.

The present disclosure provides a pixel array that can solve the technical problem of the panel color shift by changing a sub-pixel proportion of the pixel array.

In order to solve the aforementioned problem, the present disclosure provides the following technical solutions.

The present disclosure provides a pixel array. The pixel array includes a plurality of pixel units. Each pixel unit correspondingly includes a plurality of sub-pixels having a plurality of color types, and the sub-pixels having the color types include at least one blue sub-pixel.

In the pixel array, a proportion of the at least one blue sub-pixel is larger than a proportion correspondingly of at least one sub-pixel of the sub-pixels correspondingly having each color type of other color types of the color types.

In an embodiment, the pixel units include at least one first pixel unit, and in each first pixel unit of the at least one first pixel unit, a proportion of the at least one blue sub-pixel is larger than a proportion correspondingly of the at least one sub-pixel of the sub-pixels correspondingly having each color type of the other color types of the color types.

In an embodiment, the pixel units further include at least one second pixel unit, and in each second pixel unit of the at least one second pixel unit, a proportion correspondingly of at least one sub-pixel of the sub-pixels correspondingly having each color type of the color types is same.

In an embodiment, the at least one first pixel unit in the pixel array is evenly distributed.

In an embodiment, in each first pixel unit of the at least one first pixel unit, an area of a single pixel of at least one sub-pixel of the sub-pixels correspondingly having each color type of the color types is same, and a number of a plurality of the blue sub-pixels is larger than a number correspondingly of the at least one sub-pixel of the sub-pixels correspondingly having each color type of the other color types of the color types.

In an embodiment, in each first pixel unit of the at least one first pixel unit, a number correspondingly of at least one sub-pixel of the sub-pixels correspondingly having each color type of the color types is same, and an area of a single pixel of the at least one blue sub-pixel is larger than an area correspondingly of a single pixel of the at least one sub-pixel of the sub-pixels correspondingly having each color type of the other color types of the color types.

In an embodiment, the sub-pixels having the color types further include at least one red sub-pixel and at least one green sub-pixel, and in the pixel array, a proportion of the at least one red sub-pixel is equal to a proportion of the at least one green sub-pixel.

In an embodiment, in the pixel array, the proportion of the at least one blue sub-pixel is larger than one-third, and is smaller than or equal to one-half.

In an embodiment, the sub-pixels having the color types further include at least one red sub-pixel, at least one green sub-pixel, and at least one white sub-pixel, and in the pixel array, all of a plurality of proportions correspondingly of the at least one red sub-pixel, the at least one green sub-pixel, and the at least one white sub-pixel are equal to each other.

In an embodiment, in the pixel array, the proportion of the at least one blue sub-pixel is larger than a quarter, and is smaller or equal to one-half.

In an embodiment, in the pixel array, any two blue sub-pixels of the blue sub-pixels are not adjacent to each other.

In an embodiment, in each second pixel unit of the at least one second pixel unit, a number correspondingly of the at least one sub-pixel of the sub-pixels correspondingly having each color type of the color types is same, and an area of a single pixel of the at least one sub-pixel of the sub-pixels correspondingly having each color type of the color types is same.

In an embodiment, in the pixel array, any two red sub-pixels of the red sub-pixels are not adjacent to each other, and any two green sub-pixels of the green sub-pixels are not adjacent to each other.

In an embodiment, in the pixel array, any two red sub-pixels of the red sub-pixels are not adjacent to each other, any two green sub-pixels of the green sub-pixels are not adjacent to each other, and any two white sub-pixels of the white sub-pixels are not adjacent to each other.

Advantages are as follows.

In the present disclosure, a blue sub-pixel proportion in a pixel array is increased, to increase a plurality of gray scale values correspondingly of a plurality of blue sub-pixels obtained when white balance correction is performed. Therefore, color uniformity is increased, thereby significantly improving the technical problem of the panel color shift, and enhancing a display effect of a display device.

DETAILED DESCRIPTION OF PREFERRED EMBODIMENTS

Figure 1:
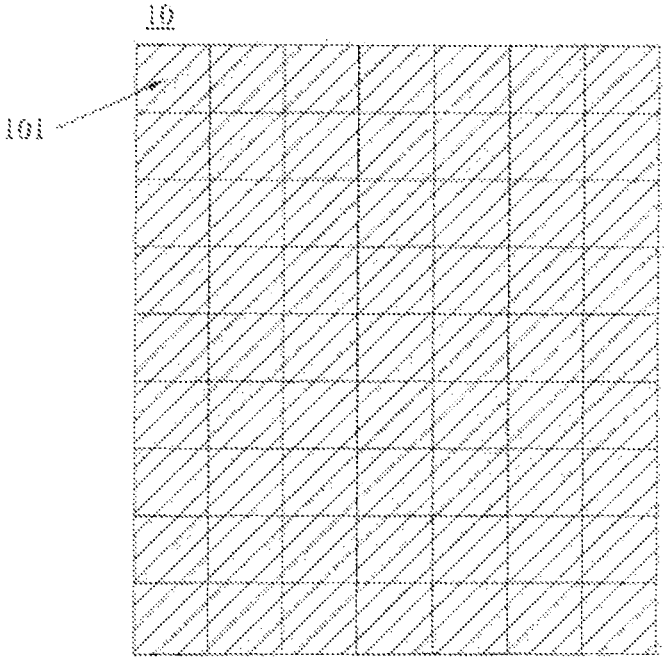
FIG. 1 is a schematic structural diagram of a pixel array in accordance with an embodiment of the present disclosure.

The description of each embodiment below refers to respective accompanying drawing(s), to illustrate exemplarily specific embodiments of the present disclosure that may be practiced. Directional terms mentioned in the present disclosure, such as "upper", "lower", "front", "back", "left", "right", "inner", "outer", "side", etc., are only directions by referring to the accompanying drawings, and thus the used directional terms are used to describe and understand the present disclosure, but the present disclosure is not limited thereto. In the drawings, structurally similar units are labeled by the same reference numerals.

The present disclosure is directed to a technical problem that, color non-uniformity of a display panel under a gray scale screen causes the display panel to generate an in-plane color shift. The present embodiment can solve the deficiency.

The present disclosure provides a pixel array to solve the aforementioned problem.

Figure 2:
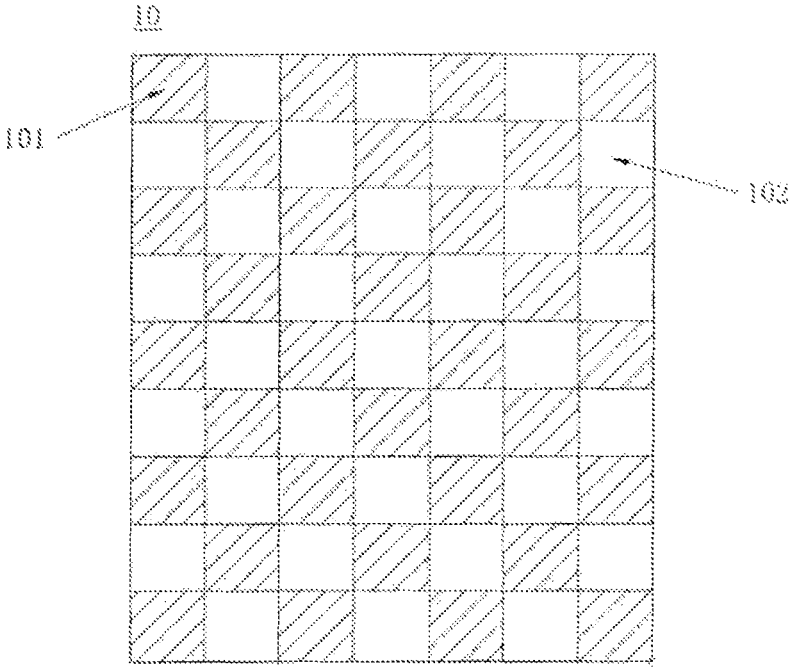
FIG. 2 is a schematic structural diagram of a pixel array in accordance with another embodiment of the present disclosure.

Referring to FIG. 1 or 2, the present disclosure provides a pixel array 10. The pixel array 10 includes a plurality of pixel units. Each pixel unit correspondingly includes a plurality of sub-pixels having a plurality of color types, and the sub-pixels having the color types includes at least one blue sub-pixel B, and a plurality of sub-pixels having other color types of the color types.

In the pixel array 10, a proportion of the at least one blue sub-pixel B is larger than a proportion correspondingly of at least one sub-pixel of the sub-pixels correspondingly having each color type of the other color types of the color types.

When a white balance correction process is performed, a plurality of gray scale values correspondingly of a plurality of blue sub-pixels B drop, causing color uniformity of a display device to be worsened. In the present embodiment, in the pixel array 10, the proportion of the at least one blue sub-pixel B is increased, and is larger than the proportion correspondingly of at least one sub-pixel of the sub-pixels correspondingly having each color type of the other color types of the color types. This causes that when the white balance correction process is performed, even if a plurality of gray scale values correspondingly of the blue sub-pixels B drop, because the proportion of the at least one blue sub-pixel B is larger, color uniformity of the pixel array 10 is improved, and a display effect of a display device is enhanced.

Specifically, as shown in Tables 1 and 2, each degree of a plurality of degrees correspondingly of a plurality of in-plane color shifts is represented by Δx and Δy, wherein Δx represents a difference between a maximum value and a minimum value of a plurality of x color coordinates correspondingly of nine different regions in a plane, and Δy represents a difference between a maximum value and a minimum value of a plurality of y color coordinates. Table 1 represents a data table when white balance correction is performed. Table 2 represents a data table when the white balance correction is not performed. As can be seen from the data tables, when the white balance correction is performed on the pixel array, both a pair of values correspondingly of Δx and Δy are increased, i.e., the in-plane color shift is worsened.

TABLE 1

| gray48-on | | | | | | | |
|---|---|---|---|---|---|---|---|
| x | y | x | y | x | y | Δx | Δy |
| 0.2582 | 0.2415 | 0.2586 | 0.2405 | 0.2527 | 0.2327 | 0.0095 | 0.0236 |
| 0.2595 | 0.2456 | 0.2531 | 0.2416 | 0.2521 | 0.2379 | | |
| 0.2616 | 0.2563 | 0.2602 | 0.2526 | 0.2555 | 0.2469 | | |

TABLE 2

| gray48-off | | | | | | | |
|---|---|---|---|---|---|---|---|
| x | y | x | y | x | y | Δx | Δy |
| 0.2369 | 0.1872 | 0.2367 | 0.1848 | 0.2319 | 0.1823 | 0.0077 | 0.0145 |
| 0.2379 | 0.1893 | 0.2314 | 0.1844 | 0.2326 | 0.1873 | | |
| 0.2391 | 0.1968 | 0.236 | 0.1893 | 0.2357 | 0.1942 | | |

Taking red, green and blue sub-pixels correspondingly having three color types as an example, based on an analysis of an effect of the white balance correction on display of the panel, a gray scale value corresponding to the blue sub-pixel B drop a lot. Taking a forty eighth level as an example, when the white balance correction is performed, a gray scale value of the blue sub-pixel B is reduced from the forty eighth level to a thirty sixth level, and a plurality of gray scale values correspondingly of the other sub-pixels are not changed. Hence, in-plane color uniformity is worsened.

As shown in Table 3, with the increase of the gray scale value of the blue sub-pixel B, a value of Δy is decreased, i.e., the in-plane color shift is improved.

TABLE 3

| R | G | B | Δy |
|---|---|---|---|
| 48 | 48 | 68 | 0.004 |
| 48 | 48 | 58 | 0.013 |
| 48 | 48 | 48 | 0.037 |
| 48 | 48 | 35 | 0.057 |
| 48 | 48 | 25 | 0.069 |

Therefore, as long as the gray scale value of the blue sub-pixel B is increased, the in-plane color shift is improved. The present embodiment improves the in-plane color shift by increasing the proportion of the at least one blue sub-pixel B in the pixel array 10.

Take the red, green and blue sub-pixels correspondingly having the three color types as an example and compare two cases. Under a first case, all of a plurality of proportions of the sub-pixels correspondingly having the three color types are one-third. Under a second case, a proportion of the blue sub-pixel B is one-half and a proportion correspondingly of one sub-pixel of the sub-pixels correspondingly having each color type of the other color types is one-fourth. When the white balance correction is performed, under the first case, a gray scale value of the blue sub-pixel B is reduced to thirty six, and a gray scale value correspondingly of one sub-pixel of the sub-pixels correspondingly having each color type of the other color types are all forty eight. Under the second case, a gray scale value of the blue sub-pixel B is fifty five, and a gray scale value correspondingly of the one sub-pixel of the sub-pixels correspondingly having each color type of the other color types is forty seven. A result is that when the proportion of the blue sub-pixel B is one-half, an in-plane color shift is improved significantly. Therefore, in the present embodiment, the gray scale values correspondingly of the blue sub-pixels B are increased by making the proportion of the at least one blue sub-pixel B to be larger than the proportion correspondingly of the at least one sub-pixel of the sub-pixels correspondingly having each color type of the other color types of the color types, to enhance a display effect of the display device.

Further, in the present embodiment, in the pixel array 10, the pixel units include at least one first pixel unit 101, and in each first pixel unit 101 of the at least one first pixel unit 101, a proportion of the at least one blue sub-pixel B is larger than a proportion correspondingly of the at least one sub-pixel of the sub-pixels correspondingly having each color type of the other color types of the color types.

There are two cases. The first case is illustrated in FIG. 1. In the pixel array 10, all of the pixel units in the pixel array 10 are correspondingly a plurality of the first pixel units 101. That is, in each pixel unit of the pixel units in the pixel array 10, the proportion of the at least one blue sub-pixel B is larger than the proportion correspondingly of the at least one sub-pixel of the sub-pixels correspondingly having each color type of the other color types of the color types.

The second case is illustrated in FIG. 2. The pixel units further include at least one second pixel unit 102. In each second pixel unit of the at least one second pixel unit, a proportion correspondingly of at least one sub-pixel of the sub-pixels correspondingly having each color type of the color types is same.

In each second pixel unit of the at least one second pixel unit, a number correspondingly of the at least one sub-pixel of the sub-pixels correspondingly having each color type of the color types is same, and an area of a single pixel of the at least one sub-pixel of the sub-pixels correspondingly having each color type of the color types is same. The pixel array 10 include the at least one first pixel unit 101 and the at least one second pixel unit 102 at the same time. The at least one first pixel unit 101 in the pixel array 10 is evenly distributed. Therefore, a display effect of a display device is enhanced.

Figure 3A:
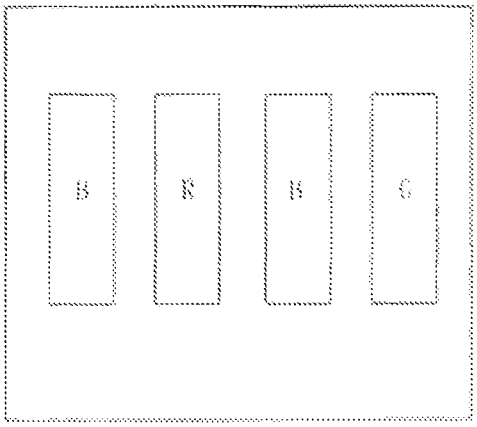
FIG. 3*a* is a schematic structural diagram of a pixel unit in a pixel array in accordance with an embodiment of the present disclosure.
Figure 3B:
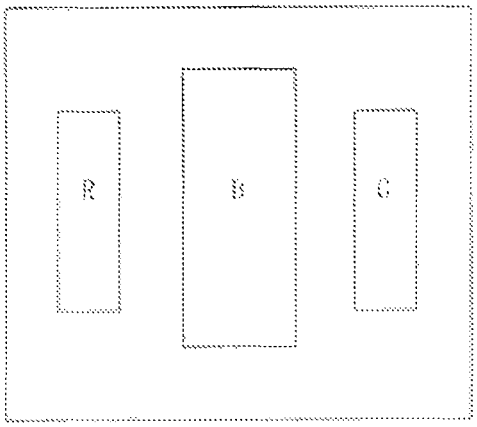
FIG. 3*b* is a schematic structural diagram of a pixel unit in a pixel array in accordance with an embodiment of the present disclosure.

In the present embodiment, as illustrated in FIG. 3*a* or 3*b*, the sub-pixels having the color types further include at least one red sub-pixel R and at least one green sub-pixel G, which with the at least one blue sub-pixel B in addition are the sub-pixels having a total of three color types. In the pixel array 10, a proportion of the at least one red sub-pixel R may be equal to a proportion of the at least one green sub-pixel G. The proportion of the at least one blue sub-pixel B in the pixel array 10 is larger than one-third. Considering effects of factors such as transmittance, chromaticity, etc., the proportion of the at least one blue sub-pixel B in the pixel array 10 is smaller than or equal to one-half.

Figure 4A:
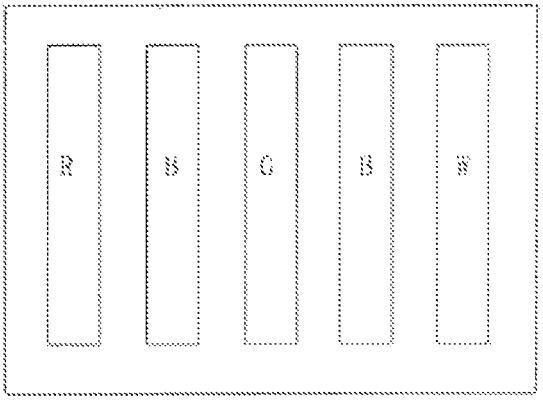
FIG. 4*a* is a schematic structural diagram of another pixel unit in a pixel array in accordance with an embodiment of the present disclosure.
Figure 4B:
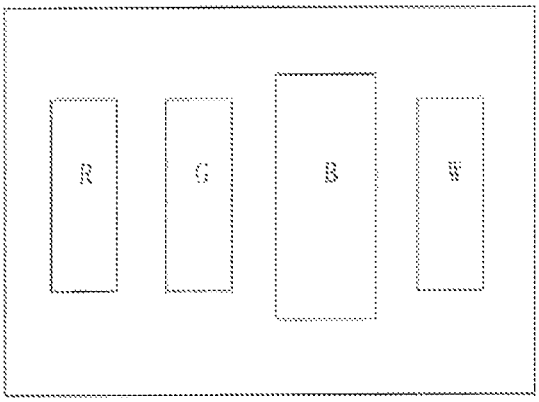
FIG. 4*b* is a schematic structural diagram of another pixel unit in a pixel array in accordance with an embodiment of the present disclosure.

In another embodiment, as illustrated in FIG. 4*a* or 4*b*, the sub-pixels having the color types further include at least one red sub-pixel R, at least one green sub-pixel G, and at least one white sub-pixel W, which with the at least one blue sub-pixel B in addition are the sub-pixels having a total of four color types. In the pixel array 10, all of a plurality of proportions correspondingly of the at least one red sub-pixel R, the at least one green sub-pixel G, and the at least one white sub-pixel W may be equal to each other. The proportion of the at least one blue sub-pixel B in the pixel array 10 is larger than a quarter. Considering effects of factors such as transmittance, chromaticity, etc., the proportion of the at least one blue sub-pixel B in the pixel array 10 is smaller than or equal to one-half.

In the present embodiment, in each first pixel unit 101 of the at least one first pixel unit 101, an area of a single pixel of at least one sub-pixel of the sub-pixels correspondingly having each color type of the color types is same, and a number of a plurality of the blue sub-pixel B is larger than a number correspondingly of the at least one sub-pixel of the sub-pixels correspondingly having each color type of the other color types of the color types. The numbers are not specifically limited here.

As illustrated in FIG. 3*a*, when the sub-pixels having the color types include the sub-pixels having the three color types, i.e., the at least one red sub-pixel R, the at least one green sub-pixel G, and a plurality of the blue sub-pixels B, a number correspondingly of each of the at least one red sub-pixel R and the at least one green sub-pixel G may be one. A number of the blue sub-pixels B may be two. The number of the blue sub-pixels B is larger than the number correspondingly of each of the at least one red sub-pixel R and the at least one green sub-pixel G. An area of a single pixel of the at least one sub-pixel of the sub-pixels correspondingly having each color type of the color types is same.

Further, when all of the pixel units in the pixel array 10 are correspondingly the first pixel units 101, in each pixel unit of the pixel units in the pixel array 10, the number of the blue sub-pixels B is two, and the number correspondingly of each of the at least one red sub-pixel R and the at least one green sub-pixel G is one.

When the pixel array 10 include the at least one first pixel unit 101 and the at least one second pixel unit 102 at the same time, in each first pixel unit 101 of the at least one first pixel unit 101, the number of the blue sub-pixels B is two, and the number correspondingly of each of the at least one red sub-pixel R and the at least one green sub-pixel G is one. In each second pixel unit of the at least one second pixel unit 102, a number correspondingly of each of the at least one blue sub-pixel B, the at least one red sub-pixel R, and the at least one green sub-pixel G may be one. The at least one first pixel unit 101 in the pixel array 10 is evenly distributed.

As illustrated in FIG. 4*a*, when the sub-pixels having the color types include the at least one red sub-pixel R, the at least one green sub-pixel G, a plurality of the blue sub-pixels B, and the at least one white sub-pixel W, a number correspondingly of each of the at least one red sub-pixel R, the at least one green sub-pixel G, and the at least one white sub-pixel W may be one. A number of the blue sub-pixels B may be two. The number of the blue sub-pixels B is larger than the number correspondingly of each of the at least one red sub-pixel R, the at least one green sub-pixel G, and the at least one white sub-pixel W. An area of a single pixel of the at least one sub-pixel of the sub-pixels correspondingly having each color type of the color types is same.

Further, when all of the pixel units in the pixel array 10 are correspondingly the first pixel units 101, in each pixel unit of the pixel units in the pixel array 10, the number of the blue sub-pixels B is two, and the number correspondingly of each of the at least one red sub-pixel R, the at least one white sub-pixel W, and the at least one green sub-pixel G is one.

When the pixel array 10 include the at least one first pixel unit 101 and the at least one second pixel unit 102 at the same time, in each first pixel unit 101 of the at least one first pixel unit 101, the number of the blue sub-pixels B is two, and the number correspondingly of each of the at least one red sub-pixel R, the at least one white sub-pixel W, and the at least one green sub-pixel G is one. In each second pixel unit of the at least one second pixel unit 102, a number correspondingly of each of the at least one blue sub-pixel B, the at least one red sub-pixel R, the at least one white sub-pixel W, and the at least one green sub-pixel G may be one. The at least one first pixel unit 101 in the pixel array is evenly distributed.

In another embodiment, in each first pixel unit 101 of the at least one first pixel unit 101, a number correspondingly of at least one sub-pixel of the sub-pixels correspondingly having each color type of the color types is same, and an area of a single pixel of the at least one blue sub-pixel B is larger than an area correspondingly of a single pixel of the at least one sub-pixel of the sub-pixels correspondingly having each color type of the other color types of the color types.

As illustrated in FIG. 3*b*, when the sub-pixels having the color types include the at least one red sub-pixel R, the at least one green sub-pixel G, and the at least one blue sub-pixels B, in each first pixel unit 101 of the at least one first pixel unit 101, a number correspondingly of the at least one sub-pixel of the sub-pixels correspondingly having each color type of the color types is same, may be one, and is not limited here. An area correspondingly of a single pixel correspondingly of each the at least one sub-pixel R and the at least one green sub-pixel G is same and is smaller than an area of a single pixel of the at least one blue sub-pixel B.

Further, when all of the pixel units in the pixel array 10 are correspondingly the first pixel units 101, in each pixel unit of the pixel units in the pixel array 10, the area of the single pixel of the at least one blue sub-pixel B is larger than the area correspondingly of the single pixel of the at least one sub-pixel of the sub-pixels correspondingly having each color type of the other color types of the color types.

When the pixel array 10 include the at least one first pixel unit 101 and the at least one second pixel unit 102 at the same time, in each first pixel unit 101 of the at least one first pixel unit 101, the area of the single pixel of the at least one blue sub-pixel B is larger than the area correspondingly of the single pixel of the at least one sub-pixel of the sub-pixels correspondingly having each color type of the other color types of the color types. In each second pixel unit of the at least one second pixel unit 102, an area correspondingly of a single pixel of the at least one sub-pixel of the sub-pixels having each color type of the color types is same. A number correspondingly of the at least one sub-pixel of the sub-pixels having each color type of the color types is same. The at least one first pixel unit 101 in the pixel array 10 is evenly distributed.

As illustrated in FIG. 4*b*, when the sub-pixels having the color types include the at least one red sub-pixel R, the at least one green sub-pixel G, the at least one white sub-pixel W, and the at least one blue sub-pixels B, in each first pixel unit 101 of the at least one first pixel unit 101, a number correspondingly of the at least one sub-pixel of the sub-pixels correspondingly having each color type of the color types is same, may be one, and is not limited here. An area correspondingly of a single pixel correspondingly of each of the at least one sub-pixel R, the at least one green sub-pixel G, and the at least one white sub-pixel W is same and is smaller than an area of a single pixel of the at least one blue sub-pixel B.

Further, when all of the pixel units in the pixel array 10 are correspondingly the first pixel units 101, in each pixel unit of the pixel units in the pixel array 10, the area of the single pixel of the at least one blue sub-pixel B is larger than the area correspondingly of the single pixel of the at least one sub-pixel of the sub-pixels correspondingly having each color type of the other color types of the color types.

When the pixel array 10 include the at least one first pixel unit 101 and the at least one second pixel unit 102 at the same time, in each first pixel unit 101 of the at least one first pixel unit 101, the area of the single pixel of the at least one blue sub-pixel B is larger than the area correspondingly of the single pixel of the at least one sub-pixel of the sub-pixels correspondingly having each color type of the other color types of the color types. In each second pixel unit of the at least one second pixel unit 102, an area correspondingly of a single pixel of the at least one sub-pixel of the sub-pixels having each color type of the color types is same. A number correspondingly of the at least one sub-pixel of the sub-pixels having each color type of the color types is same. The at least one first pixel unit 101 in the pixel array 10 is evenly distributed.

Figure 5A:
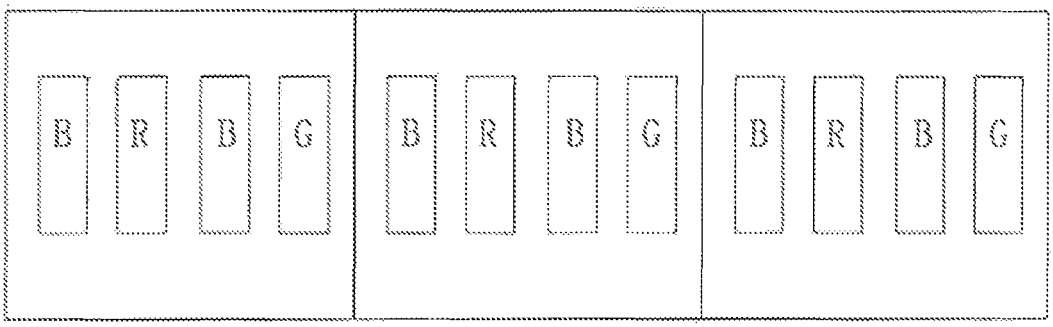
FIG. 5*a* is a schematic diagram of an arrangement manner of a plurality of sub-pixels in a pixel array in accordance with an embodiment of the present disclosure.
Figure 5B:
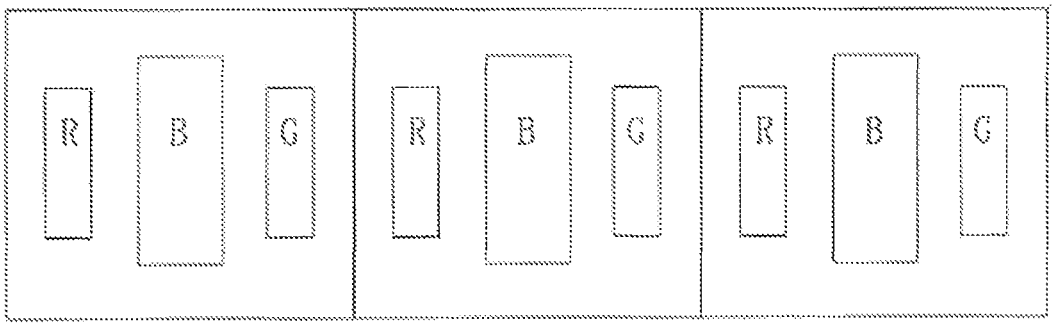
FIG. 5*b* is a schematic diagram of another arrangement manner of a plurality of sub-pixels in a pixel array in accordance with an embodiment of the present disclosure.

Each figure of FIGS. 5*a* and 5*b* correspondingly illustrates an arrangement manner of the sub-pixels having the color types correspondingly in accordance with an embodiment. In each figure of the figures, only a portion of the sub-pixels are correspondingly illustrated, and a case that the sub-pixels having the color types include the at least one red sub-pixel R, the at least one green sub-pixel G, and the at least one blue sub-pixel B is correspondingly illustrated.

In the pixel array 10, a plurality of sub-pixels correspondingly of each color type of the color types are spaced apart from each other. That is, any two red sub-pixels R of the red sub-pixels R are not adjacent to each other, any two green sub-pixels G of the green sub-pixels G are not adjacent to each other, and any two blue sub-pixels B of the blue sub-pixels B are not adjacent to each other.

When the sub-pixels having the color types include the at least one red sub-pixel R, the at least one green sub-pixel G, the at least one blue sub-pixel B, and the at least one white sub-pixel W, in the pixel array 10, a plurality of sub-pixels correspondingly of each color type of the color types are spaced apart from each other. That is, any two red sub-pixels R of the red sub-pixels R are not adjacent to each other, any two green sub-pixels G of the green sub-pixels G are not adjacent to each other, any two blue sub-pixels B of the blue sub-pixels B are not adjacent to each other, and any two white sub-pixels W of the white sub-pixels W are not adjacent to each other.

In the present embodiment, a blue sub-pixel proportion in a pixel array is increased, to increase a plurality of gray scale values of the pixel array obtained when white balance correction is performed. Therefore, color uniformity of a display device is increased and a display effect of a display device is enhanced.

In summary, although the present disclosure has been described with preferred embodiments thereof above, it is not intended to be limited by the foregoing preferred embodiments. Persons skilled in the art can carry out many changes and modifications to the described embodiments without departing from the scope and the spirit of the present disclosure. Therefore, the protection scope of the present disclosure is in accordance with the scope defined by the claims.

What is claimed is:

1. A display device, comprising:

a pixel array comprising: a plurality of pixel units, wherein each pixel unit correspondingly comprises a plurality of sub-pixels having a plurality of color types, and the sub-pixels having the color types comprise at least one blue sub-pixel; and wherein in the pixel array, a proportion of the at least one blue sub-pixel is larger than a proportion correspondingly of at least one sub-pixel of the sub-pixels correspondingly having each color type of other color types of the color types;

wherein when a white balance correction is performed on the pixel array, a gray scale value of the at least one blue sub-pixel is greater than a grayscale value correspondingly of the at least one sub-pixel of the sub-pixels correspondingly having each color type of the other color types of the color types so that in-plane color shift of the display device is improved; and wherein on the basis that the in-plane color shift of the display device is improved, the display device does not comprise a color compensation algorithm in an integrated circuit, wherein the color compensation algorithm compensates for color non-uniformity of the display device.

2. The display device of claim 1, wherein the pixel units comprise at least one first pixel unit, and in each first pixel unit of the at least one first pixel unit, a proportion of the at least one blue sub-pixel is larger than a proportion correspondingly of the at least one sub-pixel of the sub-pixels correspondingly having each color type of the other color types of the color types.

3. The display device of claim 2, wherein the pixel units further comprise at least one second pixel unit, and in each second pixel unit of the at least one second pixel unit, a proportion correspondingly of at least one sub-pixel of the sub-pixels correspondingly having each color type of the color types is same.

4. The display device of claim 2, wherein the at least one first pixel unit in the pixel array is evenly distributed.

5. The display device of claim 2, wherein in each first pixel unit of the at least one first pixel unit, an area of a single pixel of at least one sub-pixel of the sub-pixels correspondingly having each color type of the color types is same, and a number of a plurality of the blue sub-pixels is larger than a number correspondingly of the at least one sub-pixel of the sub-pixels correspondingly having each color type of the other color types of the color types.

6. The display device of claim 2, wherein in each first pixel unit of the at least one first pixel unit, a number correspondingly of at least one sub-pixel of the sub-pixels correspondingly having each color type of the color types is same, and an area of a single pixel of the at least one blue sub-pixel is larger than an area correspondingly of a single pixel of the at least one sub-pixel of the sub-pixels correspondingly having each color type of the other color types of the color types.

7. The display device of claim 1, wherein the sub-pixels having the color types further comprise at least one red sub-pixel and at least one green sub-pixel, and in the pixel array, a proportion of the at least one red sub-pixel is equal to a proportion of the at least one green sub-pixel.

8. The display device of claim 7, wherein in the pixel array, the proportion of the at least one blue sub-pixel is larger than one-third, and is smaller than or equal to one-half.

9. The display device of claim 1, wherein the sub-pixels having the color types further comprise at least one red sub-pixel, at least one green sub-pixel, and at least one white sub-pixel, and in the pixel array, all of a plurality of proportions correspondingly of the at least one red sub-pixel, the at least one green sub-pixel, and the at least one white sub-pixel are equal to each other.

10. The display device of claim 9, wherein in the pixel array, the proportion of the at least one blue sub-pixel is larger than a quarter, and is smaller or equal to one-half.

11. The display device of claim 1, wherein in the pixel array, any two blue sub-pixels of the blue sub-pixels are not adjacent to each other.

12. The display device of claim 3, wherein in each second pixel unit of the at least one second pixel unit, a number correspondingly of the at least one sub-pixel of the sub-pixels correspondingly having each color type of the color types is same, and an area of a single pixel of the at least one sub-pixel of the sub-pixels correspondingly having each color type of the color types is same.

13. The display device of claim 7, wherein in the pixel array, any two red sub-pixels of the red sub-pixels are not adjacent to each other, and any two green sub-pixels of the green sub-pixels are not adjacent to each other.

14. The display device of claim 9, wherein in the pixel array, any two red sub-pixels of the red sub-pixels are not adjacent to each other, any two green sub-pixels of the green sub-pixels are not adjacent to each other, and any two white sub-pixels of the white sub-pixels are not adjacent to each other.

* * * * *